US009061860B2

(12) United States Patent
Sprick-Schutte

(10) Patent No.: US 9,061,860 B2
(45) Date of Patent: Jun. 23, 2015

(54) DRIVE MECHANISM FOR A DEVICE FOR LAYING A FIBROUS MATERIAL WEB IN A LEPORELLO FOLD

(75) Inventor: Andreas Sprick-Schutte, Paderborn (DE)

(73) Assignee: Sprick GmbH Bielefelder Papier-und Wellpappenwerke & Co., Bielefeld (DE)

( * ) Notice: Subject to any disclaimer, the term of this patent is extended or adjusted under 35 U.S.C. 154(b) by 798 days.

(21) Appl. No.: 13/202,225

(22) PCT Filed: Feb. 17, 2010

(86) PCT No.: PCT/EP2010/000998

§ 371 (c)(1),
(2), (4) Date: Aug. 18, 2011

(87) PCT Pub. No.: WO2010/094472

PCT Pub. Date: Aug. 26, 2010

(65) Prior Publication Data

US 2011/0306482 A1 Dec. 15, 2011

(30) Foreign Application Priority Data

Feb. 18, 2009 (DE) ..... 10 2009 009 517

(51) Int. Cl.
*B65H 45/101* (2006.01)
*B31B 1/26* (2006.01)
(Continued)

(52) U.S. Cl.
CPC ..... *B65H 45/101* (2013.01); *B65H 20/32* (2013.01); *B65H 31/32* (2013.01); *B65H 35/10* (2013.01);
(Continued)

(58) Field of Classification Search
CPC ..... B65H 2701/11231; B65H 2301/4216; B65H 2404/1421; B65H 2408/212; B65H 2408/2032; B65H 31/32; B65H 35/10; B65H 45/101
USPC ..... 493/413, 414, 415, 405
See application file for complete search history.

(56) References Cited

U.S. PATENT DOCUMENTS 2,643,878 A * 6/1953 Lach ..... 270/39.05
2,710,992 A 6/1955 Goldman
(Continued)

FOREIGN PATENT DOCUMENTS

DE 1 199 119 B 8/1965
DE 1 964 858 A 7/1971
(Continued)

OTHER PUBLICATIONS

The International Bureau of WIPO, International Preliminary Report on Patentability and Translation of Written Opinion of the International Searching Authority for PCT/EP2010/000998 dated Aug. 23, 2011.
(Continued)

*Primary Examiner* — Thanh Truong
*Assistant Examiner* — Justin Citrin
(74) *Attorney, Agent, or Firm* — Dennis J. Williamson; Moore & Van Allen PLLC

(57) ABSTRACT

Drive mechanism for an apparatus for laying an in particular unfolded fibrous material web, in particular a paper web or a corrugated paper web, like a corrugated cardboard web, in a Leporello fold, comprising a pair of opposing rollers that form a passage gap for the fibrous material web and respectively define a rotational axis around which said rollers rotate, in particular when the fibrous material web passes through the passage gap, characterised by a rotational axial roller drive that rotationally drives at least one of the two rollers for delivering the fibrous material web through the passage gap to form the Leporello stacking, and a pivot drive that has in particular a pendulum axis not coinciding with the rotational axes, wherein the at least two rollers are pivot-mounted such that the rotational axes can be pivoted back and forth about the common pendulum axis.

26 Claims, 13 Drawing Sheets

(51) Int. Cl.
*B65H 20/32* (2006.01)
*B65H 31/32* (2006.01)
*B65H 35/10* (2006.01)

(52) U.S. Cl.
CPC . *B65H 2301/4216* (2013.01); *B65H 2404/1421* (2013.01); *B65H 2408/212* (2013.01); *B65H 2701/11231* (2013.01)

(56) References Cited

U.S. PATENT DOCUMENTS

| | | | | |
|---|---|---|---|---|
| 3,086,768 | A * | 4/1963 | Lach | 493/415 |
| 4,730,762 | A | 3/1988 | Felix | |
| 5,076,555 | A | 12/1991 | Bunch, Jr. | |
| 5,732,315 | A | 3/1998 | Inoue et al. | |
| 5,800,327 | A * | 9/1998 | Kishine et al. | 493/357 |
| 5,800,827 | A | 9/1998 | Igarashi et al. | |
| 6,209,288 | B1 | 4/2001 | Rahn et al. | |
| 6,378,751 | B1 * | 4/2002 | Ring | 226/118.4 |
| 7,177,587 | B2 * | 2/2007 | Sugata | 399/401 |
| 7,517,302 | B2 | 4/2009 | Kobayashi et al. | |
| 8,579,287 | B1 * | 11/2013 | Herrmann et al. | 271/302 |

FOREIGN PATENT DOCUMENTS

| | | | |
|---|---|---|---|
| DE | 35 00 766 | A1 | 7/1986 |
| DE | 85 20763 | U1 | 2/1987 |
| DE | 41 31 654 | A1 | 4/1993 |
| DE | 44 04 636 | A1 | 9/1994 |
| DE | 196 44 383 | C1 | 4/1998 |
| DE | 10 2005 013 161 | A1 | 9/2006 |
| DE | 10 2005 057 364 | A1 | 6/2007 |
| DE | 10 2006 010 069 | A1 | 9/2007 |
| EP | 0 763 492 | A2 | 6/1996 |
| EP | 2363366 | A1 * | 9/2011 |
| EP | WO 2012/022412 | * | 2/2012 |

OTHER PUBLICATIONS

European Patent Office, International Search Report for PCT/EP2010/000998 dated Aug. 26, 2010.

* cited by examiner

DRIVE MECHANISM FOR A DEVICE FOR LAYING A FIBROUS MATERIAL WEB IN A LEPORELLO FOLD

CROSS-REFERENCE TO RELATED APPLICATIONS

This application is filed under the benefit of 35 U.S.C. 371 for PCT Application No. PCT/EP2010/000998, filed Feb. 17, 2010, which claims priority to German Patent Application No. DE 102009009517.9, filed Feb. 18, 2009, the contents of both of which are hereby incorporated by reference in their entirety.

BACKGROUND

The invention relates to a drive and folding mechanism for an apparatus for laying an in particular unfolded fibrous material web, in particular a paper web or a corrugated paper web like a corrugated cardboard web in a Leporello folding.

A corrugated cardboard web is often used for packaging purposes in that, for example, separated layers of corrugated cardboard are put for cushioning transported goods adjacent to each other. A sheet of corrugated cardboard can present a contour on one side or on two sides. For a corrugated cardboard web with a contour on one side only, one side is formed by a layer of corrugated paper onto which a smooth layer of paper is glued for forming the other side. It shall be understood that the corrugated cardboard web can be formed by several flat and corrugated layers of paper put upon each other in order to increase the buffer characteristics.

In order to optimise the packaging process it is common to draw the packaging material from a packaging material source that is present either as a reel or as a Leporello-folded stack. The Leporello-folded stack is often preferred due to its rectangular outer shape and the resulting ease of storage and simple webs. The pulling off or unfolding from a Leporello-folded stack is relatively simple because no strongly dimensioned rotary bearings for a reel of corrugated cardboard are necessary. However, corrugated cardboard webs are usually provided by the paper makers in reels so that for creating a Leporello-folded stack the corrugated cardboard web first needs to be unreeled from the endless rollers and appropriately Leporello-folded.

An apparatus for laying an in particular unfolded, endless fibrous material web in a Leporello fold, which apparatus comprises a drive mechanism is known from DE 196 44 383 C1. The known Leporello folding apparatus has a platform onto which a fibrous material stack can be put by means of a stack forming mechanism. The fibrous material web is guided via several rollers from a fibrous material web source to a drive mechanism that is formed by two drive belts arranged in parallel to each other. The drive belts are arranged vertical with respect to the platform and guide the fibrous material web vertically downwards. In order to achieve the Leporello-type zigzag folding, the vertically orientated drive belts are translationally displaced back and forth in horizontal direction.

A drive mechanism for a Leporello folding apparatus is also known from DE 35 00 766 A1, in which a driving roller arranged ahead of a pair of pendulum rods pulls a web of material off a material web source and feeds it to the pair of pendulum rods which is designed to form a Leporello fold by means of a back and forth pivoting motion.

DE 19 64 858 discloses a drive mechanism for a Leporello folding apparatus in which a pulling roller pulls off the material web stationary fixed at a holder. A pivot arm is driven via a multilink chain, and the pulling roller feeds the material web towards the end of the pivot arm.

All the above named, known drive mechanisms for a Leporello folding apparatus have the disadvantage of requiring a large amount of space in order to realise the drive mechanism by means of drive belts or a combination of a driving roller and a pivoting mechanism. Furthermore, for the known drive mechanisms a large requirement for construction material as well as a large wear of those materials is to lamented and a large number of components is required.

SUMMARY

Accordingly, the drive and folding mechanism is provided for an apparatus for laying an in particular unfolded fibrous material web, in particular a paper web or a corrugated paper web like a corrugated cardboard web in a Leporello fold. The drive mechanism comprises at least one pair of rollers facing each other. The rollers form a passage gap for the fibrous material web. Therein, the passage gap can be dimensioned such that while the fibrous material web is passing through it there is always contact between the fibrous material web and two rollers. The two rollers respectively define a rotation axis wherein the rotation axes do not coincide. The rollers rotate around their own rotational axis, in particular when the fibrous material web is running through the passage gap.

According to the invention, a rotational, axial roller drive is provided driving at least one of the two rollers for conveying the fibrous material web through the passage gap formed by the two rollers towards the Leporello stacking. A pivot drive is also provided having a pendulum axis that in particular does not coincide with the rotational axis. The at least two rollers are pivotably mounted such that the rotational axis of the rollers are pivoted back and forth about the common pendulum axis upon activation by the pivot drive.

The invention enables to significantly reduce the dimension in particular of the drive mechanism and thus the complete Leporello folding apparatus, especially in vertical direction independently from the desired width of the Leporello stacking to be laid. Furthermore, surprisingly it emerged that merely a single pair of rollers, one roller of which being driven is sufficient to realise a Leporello-folded stack. From the significant reduction of the dimension in particular in vertical direction follows also a reduction of the amplitude of movement of the components of the drive mechanism. Considering that corrugated cardboard webs commonly have a width of at least 1000 mm, it became apparent that as a result of the invention and the accompanying reduction in installation height, air turbulences are reduced owing to the reduced motion amplitude, which in turn reduces drag and thus the energy necessary for driving the drive mechanism. Furthermore, it emerged that in particular for paper webs, owing to the reduced air turbulences, the fibrous material web is less impaired, which enables a more precise Leporello folding. Further, the production speed for Leporello folding can be increased.

In a preferred embodiment of the invention, the pendulum axis is essentially parallel to the rotational axes which enables a simple structure. Preferably, the pendulum axis is disposed in the area of the passage gap, which enables reduction of the installation height and the dimensions of the drive mechanism and the Leporello folding apparatus.

In a further development of the invention the distances between the pendulum axis and the rotational axes of the rollers and/or a width of the passage gap remain constant during a complete back and forth pendulum movement of the pair of rollers. In this way, a precise Leporello folding is achievable.

In a preferred embodiment of the invention, straight lines connecting the pendulum axis and the respective rotational axes define an acute or an obtuse angle that is larger than 25°, 30°, 45° or 60°, preferably equal to about 180°. It this way, it is taught to arrange the pendulum axis as close as possible to the pair of rollers in order to keep as low as possible the pivoting amplitudes of components of the drive mechanism.

In a further development of the invention, the pendulum axis extends through the passage gap transversally to a longitudinal direction or a feeding direction of the fibrous material web, in particular perpendicular thereto.

In a further development of the invention, the pendulum axis extends between the rollers. Preferably, the pendulum axis extends through the passage gap in essentially equal, shortest distances to the at least two rollers. The pendulum axis can be disposed in the area of the fibrous material web, in particular parallel thereto, preferably in a plane defined by the fibrous material web in the area of the passage gap, in particular inside the passage gap.

In a further development of the invention, the passage gap defines a dispensing direction for the fibrous material web leaving the passage gap. With reference to a vertical direction that corresponds in particular to the gravity direction and is perpendicular to the horizontal direction, during pivoting of the at least two rollers the dispensing direction can run through a pivot angle sector of at most 180° and at least 20°, preferably between 60° and 140°. The pivot angle sector thus comprises two maximum angular positions with respect to the vertical direction that are at most 90° and at least 10°. Preferably, the dispensing direction is pivoted by 45° to 75° to both sides of the vertical direction.

Preferably, the pivot angle sector is symmetrical to the vertical direction at which is disposed the pendulum axis. The pivot angle sector can depend on a distance of the passage gap to the tray, in particular to a folded sheet at the top of the already laid fibrous material web stack and dependent on a width of the Leporello fold.

In a preferred embodiment of the invention, the rotational, axial roller drive and the pivot drive are matched to each other such that during putting the fibrous material web in the Leporello fold, a dispensing direction of the fibrous material web defined by the passage gap is pointing towards a folded end of the fibrous material web stack at which the next Leporello fold of the Leporello folding is to be formed. Therein the dispensing direction can be defined by parallel tangential directions at circumferential positions of the rollers facing each other at the shortest distance, wherein in particular the circumferential positions are defined in particular by contact points of a fibrous material web at the rollers.

In a preferred embodiment of the invention, the drive mechanism is formed without a further roller, in particular without further mechanical interference on the fibrous material web, between the Leporello fold folded last in the Leporello folding and the at least two rollers. Further, it may be arranged to provide for only one single driven roller for feeding the fibrous material web.

In a preferred embodiment of the invention, the pendulum axis is mounted stationary in particular relative to a mounting rack of the apparatus or the drive mechanism.

In a preferred embodiment of the invention, the pivot drive has a driven pulley, the rotational axis of which preferably coincides with the pivoting axis P. Therein, the pivot drive may have a driving pulley coupled to the driven pulley in particular via a force transmission means like a toothed belt. A connecting rod is at one end pivotably connected to the drive pulley via a driven articulation point of the drive pulley that is eccentric with respect to a rotational axis of the drive pulley and is at the other end pivotably connected to a drive shaft via a drive articulation point eccentric with respect to the rotational axis of the drive shaft. The distances of the articulation points to their corresponding centre axis are defined such that during a continuous driving rotation of the drive shaft in only one direction the drive pulley exerts a pendulum pivoting motion. Preferably the distance of the driven articulation point to its corresponding centre axis is larger that the distance of the driving articulation point to its corresponding centre axis.

Preferably, the distance of the driven articulation point to its corresponding centre axis is adjustable at the drive pulley, wherein in particular several driven articulation points, in particular in the form of holes for receiving coupling pins of the connecting rod.

In a preferred embodiment of the invention, the rollers are adjustable to each other between fixed operating positions and lockable in said operating positions, wherein one operating position defines a large distance for introducing the fibrous material web between the at least two rollers and one operating position defines a small distance forming the passage gap.

In a preferred embodiment of the invention a forward feed of the fibrous material web in longitudinal direction of the latter is realised exclusively via the rotational, axial roller drive, in particular via exclusively one driven roller of the pair of rollers.

In a preferred embodiment of the invention the rotational, axial roller drive has two rotational motors controllable independently from each other, one of which respectively drives one respective roller of the pair of rollers.

Preferably the rotational, axial roller drive has a servo motor in particular for each roller.

In a further development of the invention, the driven roller, in particular only the driven roller, is in essentially positive engagement with the fibrous material web, in particular with a surface contour of the fibrous material web.

In a preferred embodiment of the invention, one roller of the pair of rollers is designed to press the driven roller into positive engagement with a surface contour of the fibrous material web, in particular essentially without communicating feeder drive forces in feeding direction to the fibrous material web.

In a preferred embodiment of the invention, the driven roller, in particular only one driven roller has an outer contour, in particular a wave shaped external corrugation, that is preferably adapted in particular to the wave shaped contour of the fibrous material web such that contour mountains, in particular wave mountains and contour valleys, in particular wave valleys of the fibrous material web essentially come into engagement with contour valleys, in particular wave valleys and contour mountains, in particular wave mountains of the outer contour of the driven roller.

In a preferred embodiment of the invention, one of the rollers is designed with an essentially smooth surface that is designed with low friction, in particular with respect to the fibrous material web, preferably with uncoated aluminium.

In a further development of the invention, the drive mechanism has a control unit that synchronises the pivot drive and the rotational, axial roller drive.

Furthermore, the invention relates to a method and an apparatus for laying an in particular unfolded fibrous material web, in particular a paper web or a corrugated paper web like a corrugated cardboard web in a Leporello fold. Therein the fibrous material web is severed, in particular cut off, from a stack of fibrous materials web put in a Leporello fold by inserting a horizontally mounted support plate from a passive rest position adjacent to the fibrous material web stack between an upper and a lower folded sheet of the fibrous material web stack so that the fibrous material web is cut in the area of a folded edge between the upper and the lower folded sheet and the folded sheet cut off the fibrous material web stack is deposited onto the support plate.

An apparatus for laying an in particular unfolded, endless fibrous materials web in a Leporello fold in known for example from DE 85 20 763 U1. The known apparatus for zigzag folding an endless material web comprises a tray designed as a lowerable support rake. The folded fibrous material web stack is transported away from the laying apparatus by the support rake. A stack mechanism is provided that grips the unfolded material web via support elements and folds them into a succession of sheets lying on top of each other and folded in a zigzag shape. Subsequently, the folded fibrous material web stack is cut from the fibrous material by inserting a horizontally displaceable table between two folded sheets of the Leporello stack, wherein a stationary knife is disposed at the same height as the table and realises the severing procedure in cooperation with the table. This known apparatus and this known method have the disadvantage that the Leporello fold is interrupted during the cutting and must be resumed, resulting in a discontinuous folding operation.

Accordingly, the fibrous material web following the upper folded sheet is folded on the support plate inserted in a cutting position, and precisely not on the conveyor belt usually disposed therebelow or a rigid tray platform.

In a preferred embodiment of the invention, a stack forming mechanism, in particular the above-mentioned drive mechanism of the Leporello folding apparatus according to the invention, for folding the unfolded fibrous material web in the Leporello fold, and the support plate disposed in the cutting position are movingly displaced relative to each other in order to maintain essentially constant a vertical distance between the stack forming mechanism and a folded sheet disposed on top of the newly laid fibrous material web stack. The uppermost folded sheet of the newly laid fibrous material web stack is the folded sheet that is closest to the stack forming mechanism. The uppermost folded sheet can be in direct engagement of push-down arms that compress the superimposed, folded seats.

In a preferred embodiment of the invention, the support plate is horizontally moved back into the rest position after part of the newly to be laid fibrous material web stack has been laid in order to slide off and transfer a fibrous material web stack already laid onto a stationary transport tray like a conveyor belt. The moving back can be realised so fast that an interruption of the Leporello folding does not need to occur.

The invention also relates to an apparatus for laying an in particular unfolded fibrous material web, in particular a paper web or a corrugated paper web like a corrugated cardboard web in a Leporello fold. The Leporello folding apparatus according to the invention comprises a transport tray like a conveyor belt onto which a fibrous material web stack laid in a Leporello fold is put in particular for its further transport away from the Leporello folding apparatus. In addition, the Leporello folding apparatus comprises a stack forming mechanism for folding the unfolded fibrous material web in the Leporello fold. It shall be understood that the stack forming mechanism may for example also be formed by the above-mentioned drive mechanism according to the invention. Furthermore, the Leporello folding apparatus has a severing device for severing the fibrous material web off the fibrous material web stack, wherein the severing device is formed by a horizontally mounted support plate with a cutting section. The support plate can be horizontally displaced from a rest position into a cutting position in order to sever the fibrous material web off the fibrous material web stack in such a way that the fibrous material web is cut by the cutting section in the area of a folded edge between an upper and a lower folded sheet of the fibrous material web stack, and the upper folded sheet is deposited onto the support plate. According to the invention, the stack forming mechanism and the support plate are vertically movable relative to each other such that a vertical distance between the stack forming mechanism and an uppermost, last folded and put sheet of a newly laid fibrous material web stack remains essentially constant.

Preferably, the cutting section is positioned at an edge of the support plate that is facing the fibrous material web stack. Therein, the cutting section and the support plate can be formed of one piece, in particular a metal piece. Alternatively, a separately manufactured cutting section can be fixed at the support plate, in particular at its lower side.

For cutting the fibrous material web, the cutting section cooperates with a stationary cutting block.

In a preferred embodiment of the invention, the relative movement between the stack forming mechanism and the support plate is realised in that the support plate is stationary and the stack forming mechanism is mounted in a way to perform a vertical adjustment motion. Alternatively, both stack forming mechanism and support plate may be vertically adjustable.

In a preferred embodiment of the invention, the Leporello folding apparatus has a receiving rack with at least one vertical side wall adjacent to at least a part of the folded edges of the fibrous material web stack. The side wall comprises a slot through which the support plate can pass for its insertion wherein the side wall is displaceable synchronously with the support plate so that the slot is always horizontally aligned with the support plate. Furthermore, the invention relates to an apparatus for laying an in particular unfolded fibrous material web, in particular a paper web or a corrugated paper web like a corrugated cardboard web in a Leporello fold. The Leporello folding apparatus comprises a tray onto which a fibrous material web stack that has been laid in a Leporello fold is put in particular for its further transport away from the apparatus, and a stack forming mechanism that folds the fibrous material web into a Leporello folding and is formed in particular according to the above-named drive mechanism according to the invention. According to the invention, the Leporello folding apparatus shall have two push-down arms that are disposed adjacent to the respective opposing folded edges of the folded fibrous material web stack for alternatingly performing a downward push and are essentially vertically displaceable towards the fibrous material web stack as well as away from the latter.

In a preferred embodiment of the invention, the two push-down arms are disposed adjacent to the respective opposing folded edges of the folded fibrous material web stack and are essentially vertically displaceable towards the fibrous material web stack as well as away from the latter.

In a preferred embodiment of the invention, the two push-down arms are driven by a drive, in particular respectively by one drive wherein in particular the drive has a continuously driven pulley, the rotational motion of which is transformed into a translational back and forth motion by means of a multi-articulation gear.

In a further development of the invention, the Leporello folding apparatus has a control unit that synchronises the pivot drive, the rotational, axial roller drive, the drive for displacing the stack forming mechanism and/or the tray in vertical direction as well as the push-down drive(s).

In a further development of the invention, the Leporello folding apparatus has a position sensor for determining the position of the rollers of a drive mechanism, in particular the pivot drive, of a vertical distance and of the push-down arms wherein the position sensors are connected to a control unit.

Such a corrugated paper web is used among others to be employed as packaging material in that it is drawn in by a packaging machine and deformed in order to form a packaging material that is most dampening.

Further advantages, characteristics and features of the invention will become apparent by the following description of the preferred embodiment of the invention in conjunction with the accompanying drawings, showing:

DETAILED DESCRIPTION

Figure 1:
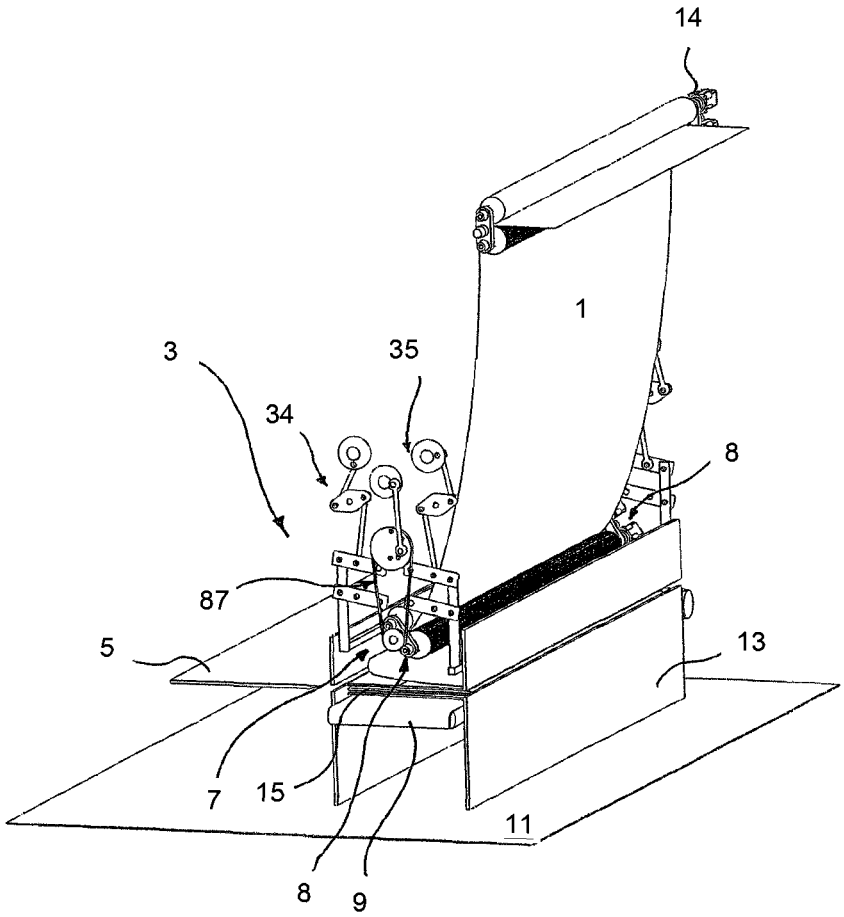
FIG. 1 a perspective view of the apparatus for laying a corrugated cardboard web in a Leporello fold according to the invention.

FIG. 1 shows an apparatus according to the invention for laying in a Leporello fold an endless corrugated cardboard web 1 reeled off a corrugated cardboard web reel (not represented) or produced in a corrugated cardboard manufacturing installation (not represented), generally given the reference numeral 3. The corrugated cardboard web 1 has a smooth side (not represented) as well as a corrugated side (not represented), wherein the corrugated contour side is facing the rollers represented in dark colour in FIG. 1.

The putting apparatus 3 according to the invention comprises as main components a cutting plate 5, a stack forming mechanism 7, a conveyor belt 9, a support rack 13 resting on a floor 11 as well as a pair of roller feeders 14 that draws the corrugated cardboard web 1 off the corrugated cardboard reel and transfers it to the stack forming mechanism 7.

As evident from FIG. 1, the corrugated cardboard web 1 is brought by the stack forming mechanism 7 in a Leporello fold, which represents a zigzag folding and is put onto an upper side of the conveyor belt 9. The stack forming mechanism 7 is essentially formed by a drive mechanism 8 according to the invention that is responsible for the forward feed of the corrugated cardboard web 1 as well as for its folding in the Leporello fold.

The drive mechanism 8 comprises a pair 17 of rollers formed by two opposing rollers 19, 21.

The rollers 19, 21 define rotational axes disposed parallel to each other, wherein the rollers 19, 21 are mounted rotatably around their axis. The rollers 19, 21 are rotatably mounted at a common side plate 16 that is pivotable back and forth.

In FIGS. 2 to 5 the operation of the Leporello stack forming mechanism is now explained in detail.

The conveyor belt 9 is downwards displaceable in vertical direction V relative to the stack forming mechanism 7 in order to maintain essentially constant a distance A between a pendulum axis P that will be explained in detail later, and its uppermost folded sheet 51 of the Leporello-folded stack 15 formed by the stack forming mechanism 7.

The essential component of the stack forming mechanism 7 consists of the pair 17 of rollers formed by the smooth roller 19 and the corrugated roller 21. The corrugated roller 21 has a circumferential external corrugation, the corrugation contour of which has a complementary shape to a single sided wave contour of the corrugated cardboard web 1. In this way, an essentially slippage-free feed of the corrugated cardboard web 1 towards the Leporello-folded stack 15 is possible. Exclusively the corrugated roller 21, which is continuously, rotationally driven by an electric motor not shown in detail, provides forward feeding of the corrugated cardboard web. The smooth roller 19 is also driven by its own motor. However, the smooth roller 19 only serves to bring the corrugated contour of the corrugated cardboard web 1 into positive engagement with the corrugated roller 21. Since the smooth roller 19 has its one, separate drive no acceleration forces like friction forces are communicated to the corrugated cardboard web in transport direction by the smooth roller 19, for example owing to its inertia, so that the forward feed forces of the corrugated cardboard web are only generated by the corrugated roller 21. In order to keep the friction forces between the smooth roller 19 and the corrugated cardboard web 1 as low as possible, the smooth roller 19 is made of an uncoated aluminium.

During operation the smooth roller 19 and the corrugated roller 21 are arranged at a constant distance to each other while forming a predetermined passage gap 23 through which extends the corrugated cardboard web 1. The dimensions of the passage gap 23 are such that the corrugated cardboard web is always in contact with the two rollers 19, 21 when passing through the passage gap 23. The smooth roller 19 has the function to press the corrugated cardboard web 1 into the positive engagement with the corrugated roller 21.

In order to realise the Leporello folding, the pair 17 of rollers mounted at the side plates 16 can be pivoted about a common pendulum axis P extending through the passage gap 23 with equal distances to the rollers 19, 21. The pendulum axis P is essentially disposed in a plane defined by the corrugated cardboard web 1 in the passage gap 23.

In order to make the pair 17 of rollers rotate about the pendulum axis P, a pendulum drive 87 (not represented) is provided that can be controlled independently from the other drives, like the rotational drive of the rollers 19, 21, by a control unit.

The passage gap 23 defines a dispensing direction R relative to the Leporello fold that is in turn essentially defined by the tangential direction of a contact point of the corrugated cardboard web 1 at the respective rollers 19, 21. The pivot area sector A is adjusted such that the corrugated cardboard web 1 is continuously pushing itself away from a formed folded edge from left to right and from right to left, which prevents that contact occurs too early between a folded sheet just about to be laid and the stack 15 already folded.

As evident from FIGS. 2, 3, 4 and 5, the pendulum drive 87 allows the dispensing direction R of the pair 17 of rollers to run through a pivot sector A of about 110° pivoting back and forth. Through the interaction of the back and forth pivoting motion and the forward feed of the corrugated cardboard web 1 realised by the corrugated roller 21 it is easily achieved with a simple design to maintain the corrugated cardboard web 1 in the desired curvature direction for forming the Leporello fold.

In order to create irreversible folding edges into the Leporello fold, a pair of push-down arms 24, 25 are provided that can be displaced in vertical direction V towards the folded stack 15 and away from the latter in order to push the folded stack 15 together with the fold folded last.

The push-down arms 24, 25 are driven by an independent drive 33, 35 that generates a continuous rotary motion of a drive pulley 27, 29 in one rotational direction. A multi articulation gear 31, 33 is employed to transform the rotational motion of the drive pulley 27, 29 into a vertical up and down motion of the push-down arms 23, 25.

It shall be understood that the forward feed drive of the corrugated roller 21, the pendulum drive 87 as well as the drive for the push-down arms 24, 25 can be synchronised by a control unit 81.

Figure 2:
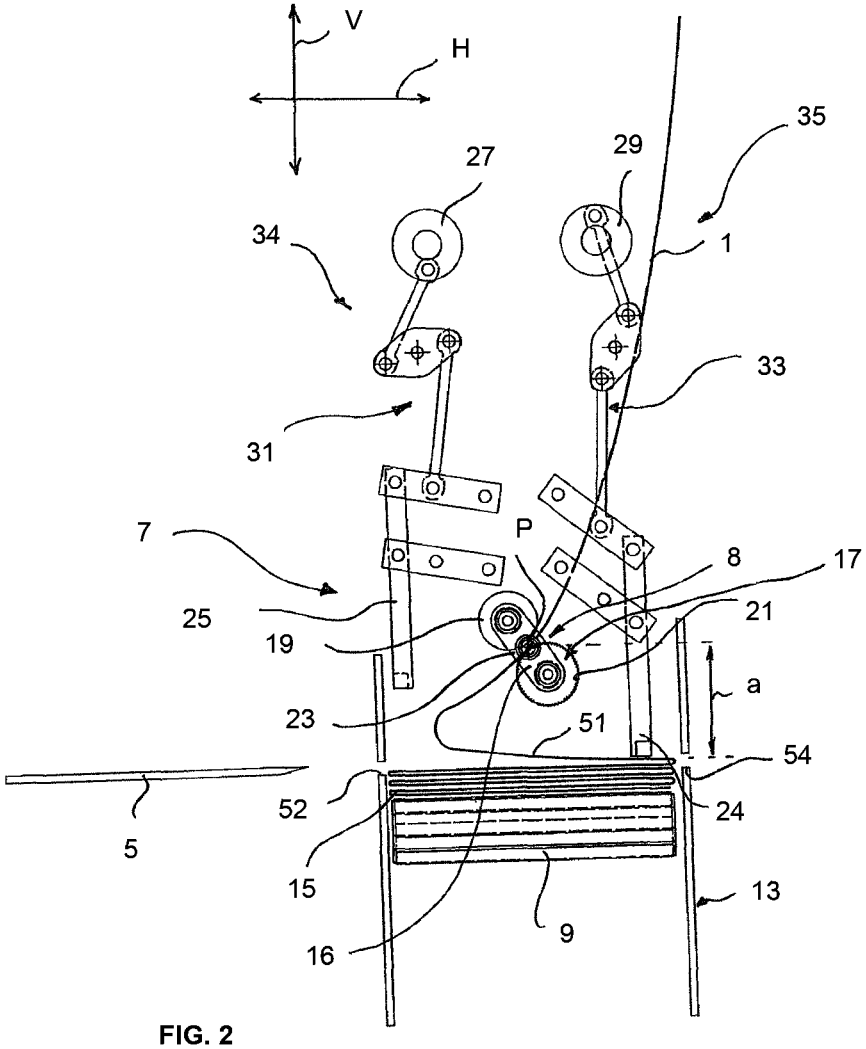
FIG. 2 a schematic lateral view of the apparatus according to the invention as in FIG. 1 in a first operating position.
Figure 3:
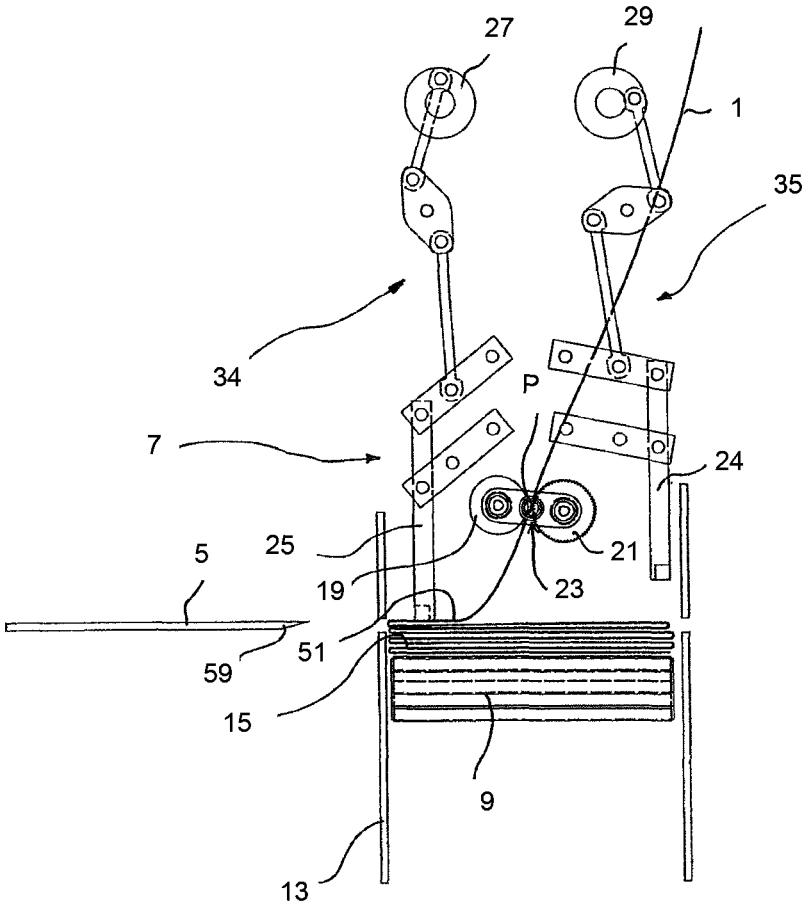
FIG. 3 a schematic lateral view of the apparatus according to the invention as in FIG. 1 in a second operating position.
Figure 4:
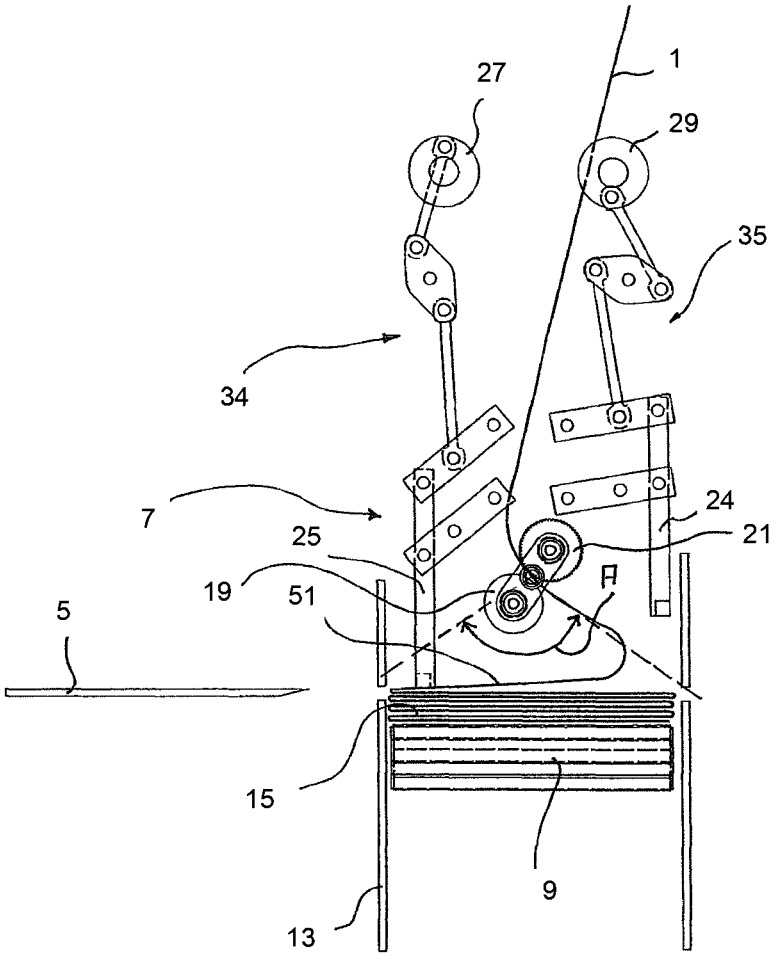
FIG. 4 a schematic lateral view of the apparatus according to the invention as in FIG. 1 in a third operating position.
Figure 5:
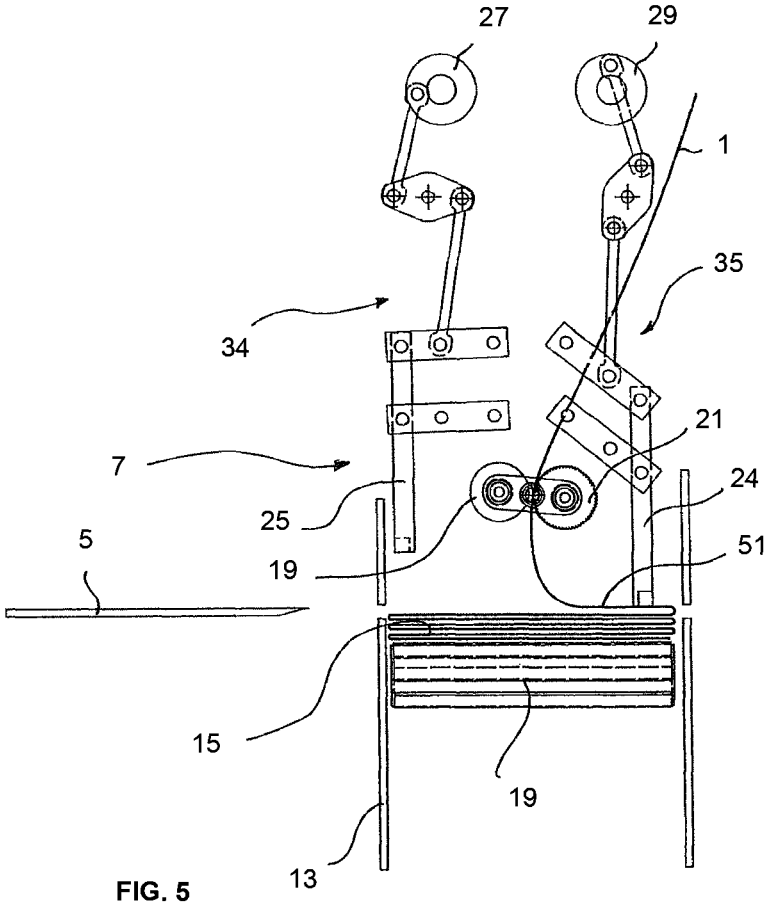
FIG. 5 schematic lateral view of the apparatus according to the invention as in FIG. 1 in a fourth operating position.
Figure 6:
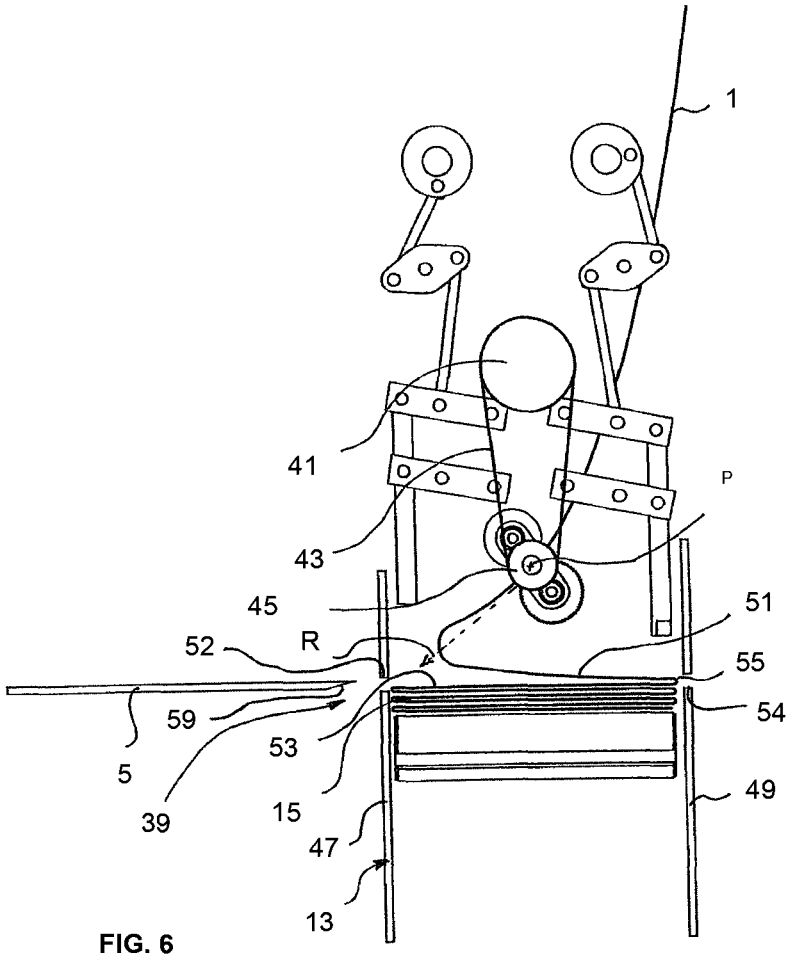
FIG. 6 schematic lateral view of the apparatus for severing the corrugated cardboard web of the Leporello-folded stack according to the invention as in FIG. 1 in a first operating position.

As evident from FIGS. 2 and 4, the push-down arm 24, 25 reaches its lowest pressure position when the stack forming mechanism 7 has concluded a Leporello stacking at a side of a folded edge and is just in the process to pivot the corrugated cardboard web 1 to the opposing edge. Through the pressure of the push-down arms 24, 25 the Leporello stacking is folded in a precise position whereby the uppermost folded sheet 51, folded last, is stationary. This stationary fixation of the uppermost folded sheet 51 is supported by the mutual corrugation engagement of the folded sheets 51, 53 piled upon each other. At their end facing the Leporello fold the push-down arms extend across the complete width of the corrugated cardboard web 1.

Figure 8:
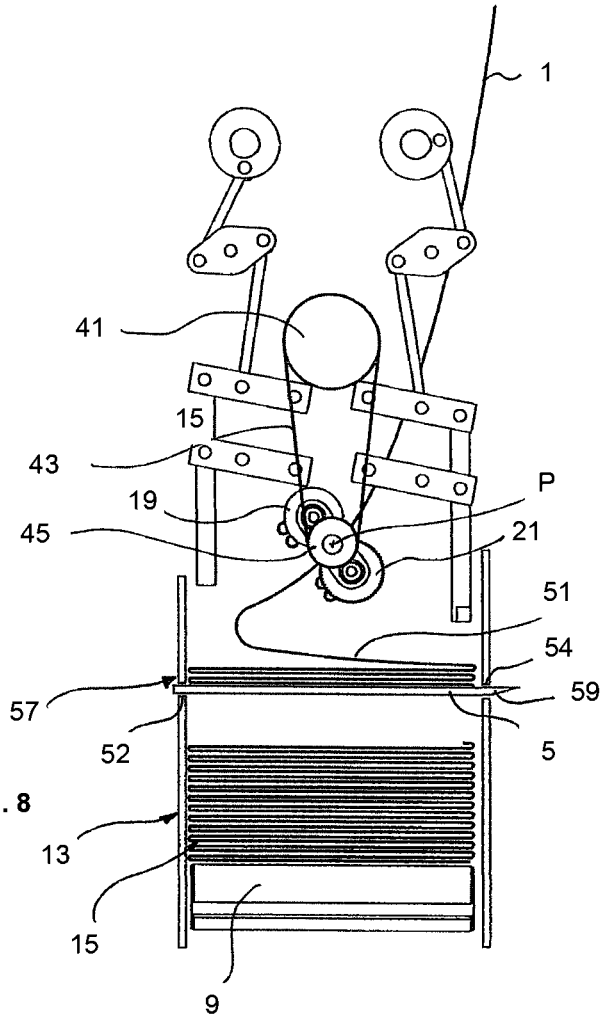
FIG. 8 a schematic lateral view of the apparatus according to the invention as in FIG. 6 in a third operating position.
Figure 9:
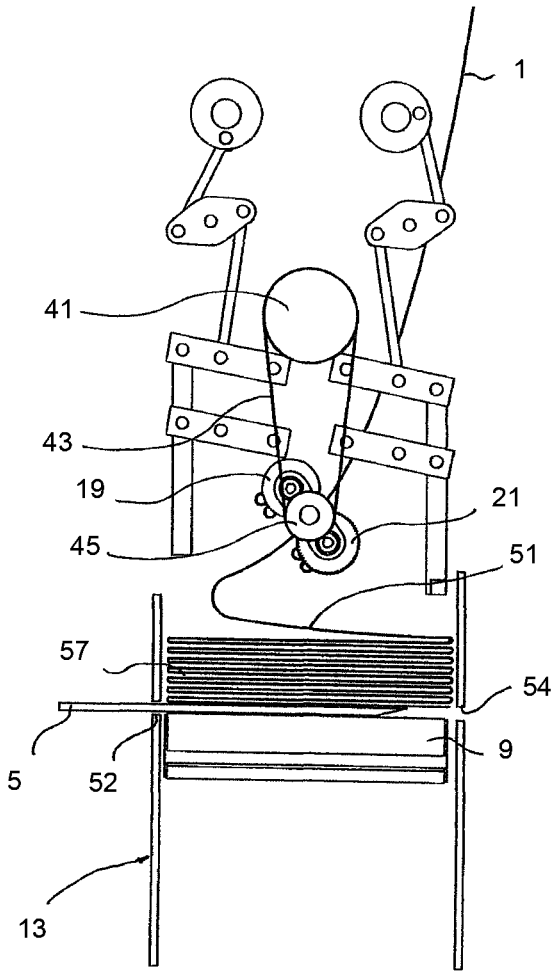
FIG. 9 a schematic lateral view of the apparatus according to the invention as in FIG. 6 in a fourth operating position.
Figure 10:
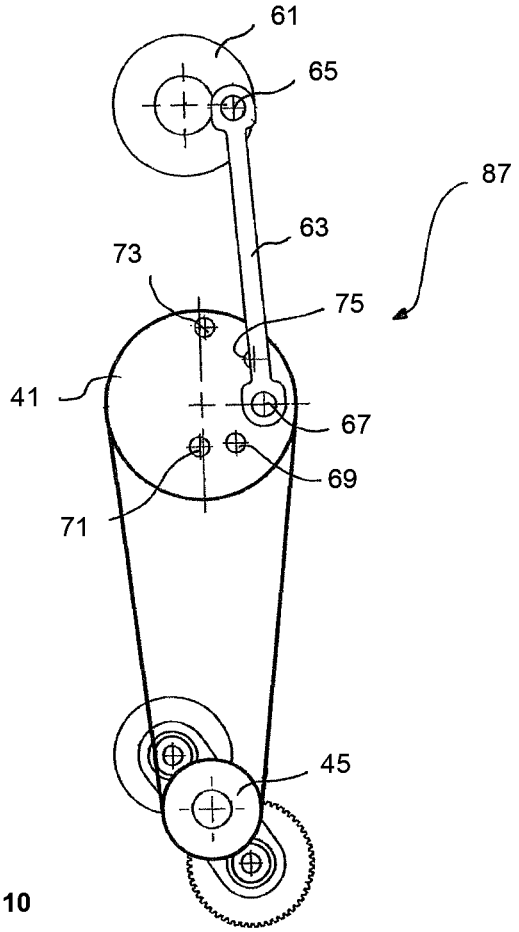
FIG. 10 a schematic lateral view of a pendulum drive for pivoting a pair of rollers of the stack forming mechanism.

FIGS. 6 to 9 show the functionality of a severing device 39 that comprises the cutting plate 5 and is designed to realise a severing of the corrugated cardboard web 1 from the completely laid Leporello-folded stack 15. In FIGS. 6 to 9 the pendulum drive 87 for pivoting back and forth the pair 17 of rollers is also shown in detail, which pendulum drive 87 consists of a drive pulley 41 connected via a toothed belt 43 to a driven pulley 45 having a rotational bearing axis coinciding with the pivot axis P. The detailed structure of the pendulum drive 87 is represented in FIG. 10.

FIG. 6 shows again how the Leporello-folded stack 15 is formed. Once the Leporello-folded stack 15 has reached the desired stacking height, as for example shown in FIG. 7, the horizontally guided and driven cutting plate 5 is guided through a slot 52, 54 formed in vertical side walls 47, 49 of the support rack 13, wherein the end of the cutting plate 5 facing the support rack 13 is sharpened as a knife and suitable for severing the Leporello-folded stack 15 from the corrugated cardboard web 1.

Figure 7:
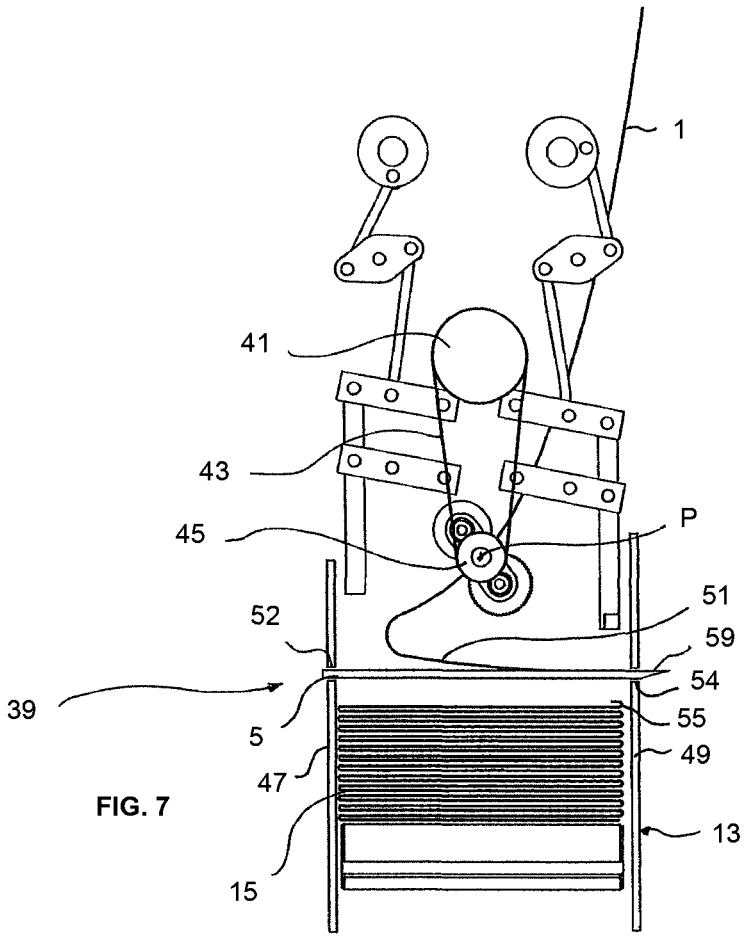
FIG. 7 a schematic lateral view of the apparatus according to the invention as in FIG. 6 in a second operating position.

The cutting plate 5 is inserted between the uppermost folded sheet 51 and the folded sheet 53 disposed directly therebelow and cuts the corrugated cardboard material at the uppermost folded edge 55 distal to the cutting plate 5 so that the uppermost folded sheet 51 is deposited onto the inserted cutting plate 5 as indicated in FIGS. 7 and 8. Thereupon a new Leporello-folded stack 57 is not deposited onto the conveyor 9 anymore but onto the cutting plate 5. In this way, the stack forming mechanism 7 can continue to work without interruption also during the severing process, that is without having to interrupt the Leporello folding. As soon as the conveyor belt 9 has transported away the completed Leporello-folded stack 15 and is free for receiving a new folded stack, the conveyor belt 9 moves to the lower side of the cutting plate 5, as indicated in FIG. 9. As soon as the final position of the conveyor belt 9 is reached, the cutting plate 5 retracts outwards from the support rack 13 through the slot 52, 54 whereby the newly to be laid Leporello-folded stack 57 is transferred to the conveyor belt 9. Thereby, the conveyor belt 9 can be brought upwards suddenly by the thickness of the cutting plate 5 in order to maintain essentially constant the distance between the stationary pendulum axis P and the uppermost folded sheet 51.

It shall be understood that the support rack 13 as well as the cutting plate 5 are displaced vertically downwards during the Leporello folding on the cutting plate 5 in order to maintain the distance A constant. Alternatively, the stack forming mechanism 7 or else the support rack 13, the cutting plate 5 as well as the stack forming mechanism 7 can be vertically displaceable in order to maintain constant the distance A.

Figure 12A:
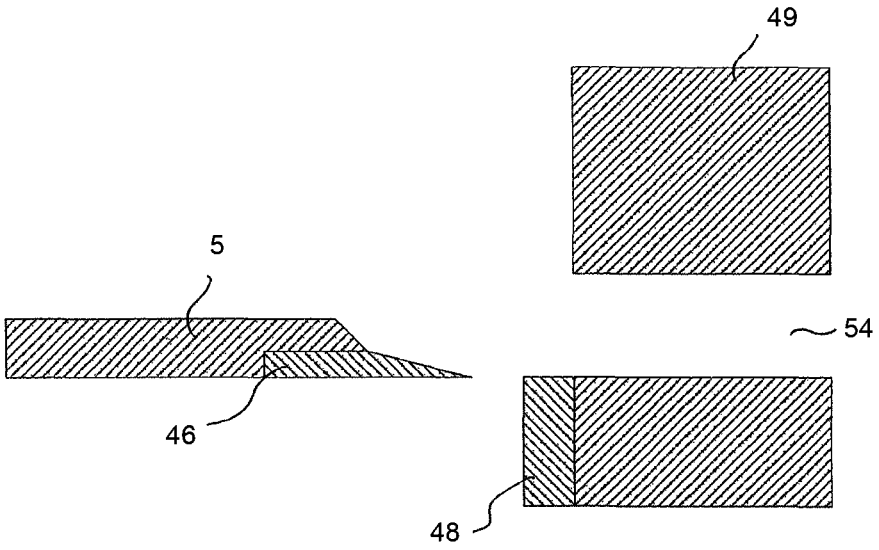
FIG. 12*a*/12*b* a cross sectional view of a severing device in a passive/active state.
Figure 12B:
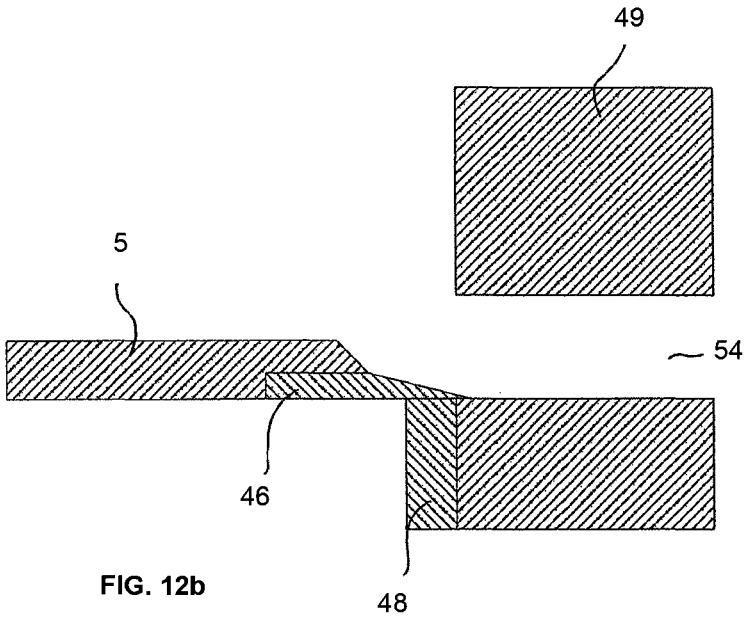

The process of cutting and the cooperation of the cutting plate 5 with the slot 54, respectively the side wall 49 is represented in FIGS. 12*a* and 12*b*.

The cutting plate 5 has at its lower side a cutting section 46 presenting a cutting end. The cutting end cooperates with a stationary cutting block 48, fixed inside the side wall, in that the cutting blade slides along the upper side of the cutting block. To that end the cutting section 46 is introduced into the slot 54.

The pendulum drive 87 is represented in detail in FIG. 10, wherein a motor-driven shaft 61 is driving the drive pulley 41 via a connecting rod 63. As evident in FIG. 10, the distance of the articulation point 65 to its respective centre axis is smaller at the shaft 61 than the distance between the articulation point 67 to its respective centre axis at the drive pulley 41, whereby a continuous rotational motion of the shaft 61 in one rotational direction, like clockwise, is transformed in a back and forth pivoting of the drive pulley 41 and thus the driven pulley 45.

As evident from FIG. 10, the drive pulley 41 comprises several holes 69 to 75 that create options for different articulation points 67 in order to adjust the gear transmission of the pendulum drive 87.

Figure 11:
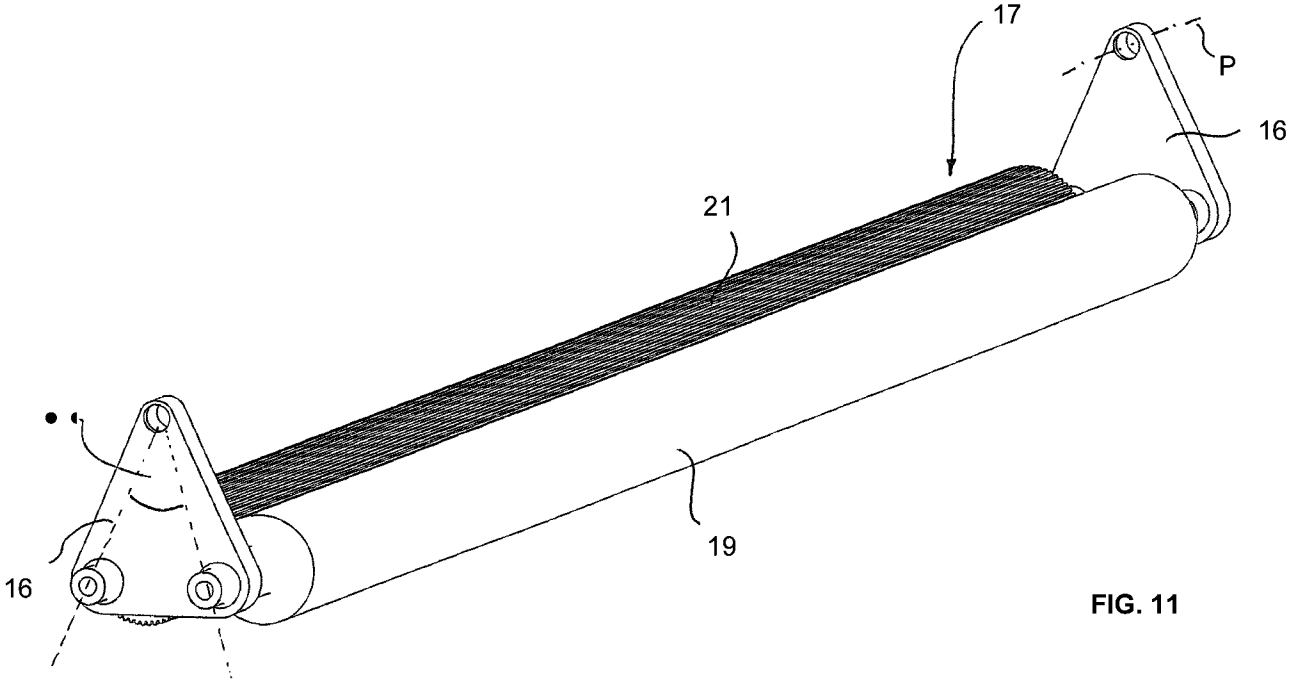
FIG. 11 a perspective detailed view of main components of the drive mechanism according to the invention.

In FIG. 11, a different arrangement of the pair 17 of rollers and the pendulum axis P is represented. In contrast to FIGS. 1 to 9, in this embodiment the pendulum axis P is not disposed inside the passage gap 23 but offset in the direction away from the Leporello folding. Therein the straight lines connecting the pendulum axis P and the rotational axis of the rollers 19, 21 form an angle $\alpha$ that is preferably larger than 25°. In the roller pair arrangement shown in FIGS. 1 to 9, the angle $\alpha$ amounts to 180°.

Figure 13:
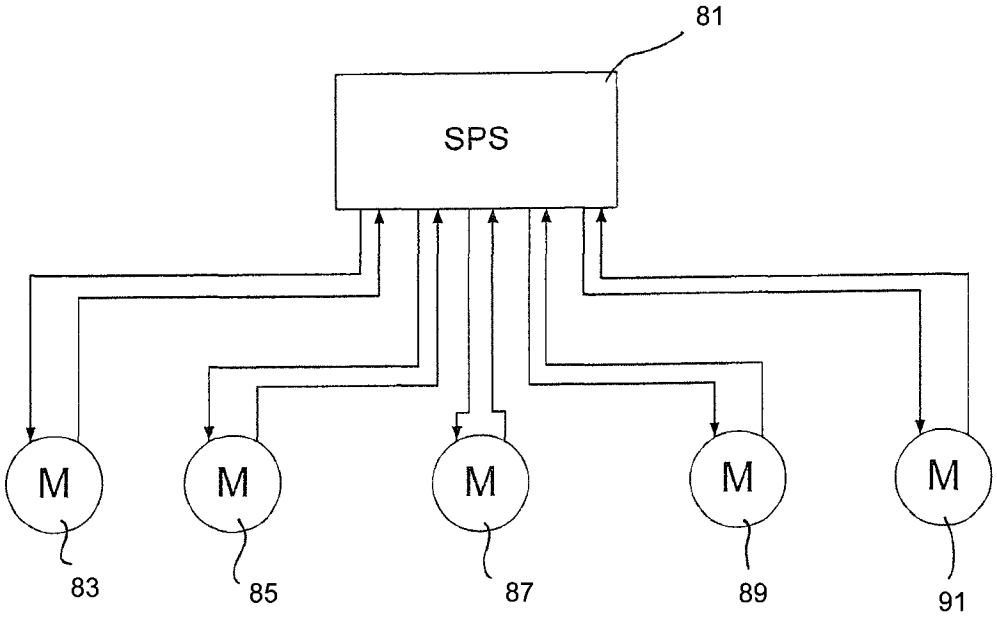
FIG. 13 a schematic block diagram for a control device of the apparatus according to the invention.

The side plates 16 are pivotable about the pendulum axis P, wherein the rollers 19, 21 are rotatably mounted at the side plates 16. Otherwise, the functionality of the roller pair arrangement according to FIG. 11 is equal to the arrangement shown in FIG. 1. In FIG. 13 a control unit 81 is represented that is connected to the motor drives 83, 85 for the rollers 19, 21, the pendulum drive 87 and the push-down arm drives 88, 91.

The respective drives 83, 85, 87, 89, 91 comprise position sensors that are not shown in detail. Position signals are transmitted to the control unit 81 via respective communication lines, represented by arrows pointing towards the control unit 81, which enables to execute a control routine. The control unit 81 serves the purpose of synchronising the motion of the rollers 19, 21 and thus the forward feed of the corrugated cardboard web 1 as well as the back and forth pendulum motion of the pair 17 of rollers as well as the movement of the push-down arms 24, 25.

The features disclosed in the above-description, the figures and the claims can be relevant for the realisation of the invention individually as well as in any combination.

What is claimed is:

1. Drive mechanism for an apparatus for laying an unfolded fibrous material web, a paper web, a corrugated paper web, or a corrugated cardboard web, in a Leporello fold, comprising a pair of opposing rollers that form a passage gap for the fibrous material web and respectively define a rotational axis around which said rollers rotate when the fibrous material web passes through the passage gap, including a rotational axial roller drive that rotationally drives at least one of the two rollers for delivering the fibrous material web through the passage gap to form the Leporello stacking, and a pivot drive that has a pendulum axis (P) not coinciding with the rotational axes of the respective rollers, wherein the at least two rollers are pivot-mounted such that the respective rotational axes can be pivoted back and forth about the common pendulum axis (P), wherein the pivot drive includes a driven pulley the rotational axis of which coincides with the pendulum axis (P) and the pivot drive includes a drive pulley that is coupled to the driven pulley via a force transmission means, wherein a connecting rod is pivotably connected to the drive pulley via a driven articulation point of the drive pulley that is eccentric with respect to a rotational axis of the drive pulley and is pivotably connected to a drive shaft via a drive articulation point eccentric with respect to a rotational axis of the drive shaft, and wherein the distances of the articulation points to their corresponding rotational axes are defined such that during a continuous driving rotation of the drive shaft in only one direction the drive pulley exerts a pendulum pivoting motion.

2. Drive mechanism according to claim 1, wherein the pendulum axis (P) is essentially parallel to the rotational axes.

3. Drive mechanism according to claim 1, wherein the pendulum axis (P) is disposed in the area of the passage gap.

4. Drive mechanism according to claim 1, wherein during a complete pendulum movement back and forth of the pair of rollers axial distances between the pendulum axis (P) and the rotational axes of the rollers and/or a width of the passage gap remain constant.

5. Drive mechanism according to claim 1, wherein straight lines connecting the pendulum axis (P) and the respective rotational axes define an acute or an obtuse angle larger than 25°, larger than 30°, larger than 45°, larger than 60°, or larger than about 180°.

6. Drive mechanism according to claim 1, wherein the pendulum axis (P) extends through the passage gap transversally to a longitudinal direction or feeding direction of the fibrous material web perpendicular thereto.

7. Drive mechanism according to claim 1, wherein the pendulum axis (P) extends between the rollers.

8. Drive mechanism according to claim 1, wherein the pendulum axis (P) extends through the passage gap in essentially equal, shortest distances to the at least two rollers.

9. Drive mechanism according to claim 1, wherein the pendulum axis (P) is disposed in the area of the fibrous material web parallel thereto, in a plane defined by the fibrous material web in the area of the passage gap or in the passage gap.

10. Drive mechanism according to claim 1, wherein the passage gap defines a dispensing direction (R) for the fibrous material web leaving the passage gap, which dispensing direction (R), upon pivoting of the at least two rollers, runs through a pivot angle sector (A) of at most 180° and at least 20° with respect to a vertical direction (V) corresponding essentially to the gravity direction.

11. Drive mechanism according to claim 10, wherein the pivot angle sector (A) is disposed symmetrically to the vertical direction (V) through which the pendulum axis (P) passes.

12. Drive mechanism according to claim 10, wherein the pivot angle sector (A) is adjustable depending on a distance from the passage gap to the upper folded sheet of the fibrous material stack and on a width of the Leporello fold.

13. Drive mechanism according to claim 1, wherein the rotational axial roller drive and the pivot drive are matched to each other such that during putting the fibrous material web, a dispensing direction (R) for the fibrous material web defined by the passage gap is pointing towards a folded end of the fibrous material web stack at which a next Leporello fold of the Leporello folding is to be formed.

14. Drive mechanism according to claim 13, wherein the dispensing direction (R) is defined by parallel tangential directions at circumferential positions of the rollers facing each other at the shortest distance, wherein the circumferential positions are defined by contact points of the fibrous material web at the rollers.

15. Drive mechanism according to claim 1, wherein the mechanism is formed without a further roller between the Leporello fold stacked on a tray and the at least two rollers without a further mechanical interference on the fibrous material web.

16. Drive mechanism according to claim 1, wherein the distance of the driven articulation point to its corresponding centre axis is larger than the distance of the driving articulation point to its corresponding centre axis.

17. Drive mechanism according to claim 1, wherein the distance of the driven articulation point to its corresponding centre axis is adjustable at the drive pulley, wherein several driven articulation points are provided in the form of holes for receiving coupling pins of the connecting rod are provided at the drive pulley.

18. Drive mechanism according to claim 1, wherein the rollers are adjustable to each other between fixed operating positions and lockable in said operating positions, wherein one operating position defines a large distance for introducing the fibrous material web between the at least two rollers and one operating position defines a small distance forming the passage gap.

19. Drive mechanism according to claim 1, wherein a forward feed of the fibrous material web in the longitudinal direction of the latter is provided via the rotational axial roller drive.

20. Drive mechanism according to claim 1, wherein the rotational axial roller drive has two rotary motors controllable independently from each other, one of which respectively drives one respective roller of the pair of rollers.

21. Drive mechanism according to claim 1, wherein the rotational axial roller drive has a servo motor for each roller.

22. Drive mechanism according to claim 1, wherein the at least one rotationally driven roller is in essentially positive engagement with the fibrous material web.

23. Drive mechanism according to claim 1, wherein one roller of the pair of rollers is designed to press the at least one rotationally driven roller into positive engagement with a surface contour of the fibrous material web without communicating feeder drive forces in the feeding direction to the fibrous material web.

24. Drive mechanism according to claim 1, wherein the at least one rotationally driven roller has an outer contour with a wave shaped external corrugation that is adapted to the wave shaped contour of the fibrous material web such that contour mountains and/or contour valleys of the fibrous material web essential come into engagement with contour valleys and/or contour mountains of the outer contour of the at least one rotationally driven roller.

25. Drive mechanism according to claim 1, wherein one of the rollers is designed with an essentially smooth surface of uncoated aluminium for low friction with respect to the fibrous material web.

26. Drive mechanism according to claim 1, wherein it has a control unit that synchronises the pivot drive and the rotational axial roller drive.

* * * * *